US008890756B2

(12) United States Patent
Tsai et al.

(10) Patent No.: US 8,890,756 B2
(45) Date of Patent: Nov. 18, 2014

(54) MULTI-POINT DRIVING DEVICE FOR GENERAL PURPOSE BASE STATION ANTENNA

(71) Applicant: Gemintek Corporation, Taipei (TW)

(72) Inventors: Ming-Chang Tsai, Taipei (TW); Jong-Hsi Huang, Taipei (TW)

(73) Assignee: Gemintek Corporation, Taipei (TW)

( * ) Notice: Subject to any disclaimer, the term of this patent is extended or adjusted under 35 U.S.C. 154(b) by 190 days.

(21) Appl. No.: 13/706,495

(22) Filed: Dec. 6, 2012

(65) Prior Publication Data

US 2013/0169495 A1 Jul. 4, 2013

(30) Foreign Application Priority Data

Dec. 30, 2011 (TW) ..... 100149816 A

(51) Int. Cl.
*H01Q 3/02* (2006.01)
*H01Q 1/24* (2006.01)

(52) U.S. Cl.
CPC . *H01Q 3/02* (2013.01); *H01Q 1/246* (2013.01)
USPC ..... 343/757; 343/882; 343/890

(58) Field of Classification Search
CPC ..... H01Q 3/02; H01Q 1/246; H01Q 1/18; H01Q 3/08
USPC ..... 343/757, 758, 759, 766, 882, 890
See application file for complete search history.

(56) References Cited

U.S. PATENT DOCUMENTS

| | | | | |
|---|---|---|---|---|
| 6,864,837 | B2 * | 3/2005 | Runyon et al. | 342/372 |
| 8,330,668 | B2 * | 12/2012 | Deng et al. | 343/754 |
| 2005/0134512 | A1 | 6/2005 | Gottl et al. | |
| 2006/0244669 | A1 * | 11/2006 | Mansour et al. | 343/757 |
| 2009/0135074 | A1 | 5/2009 | Yang et al. | |
| 2010/0201590 | A1 | 8/2010 | Girard et al. | |

FOREIGN PATENT DOCUMENTS

| | | |
|---|---|---|
| CN | 102122758 A | 7/2011 |
| TW | 320786 | 11/1997 |
| TW | 538557 | 6/2003 |

* cited by examiner

*Primary Examiner* — Hoanganh Le
(74) *Attorney, Agent, or Firm* — Rosenberg, Klein & Lee

(57) ABSTRACT

A multi-point driving device is provided for a general-purpose base station antenna and includes a fixed member, at least three direction-changeable connectors, a rigid base station antenna, and at least one linear actuator. The fixed member is coupled to an end of at least one direction-changeable connector, which provides a function of direction change. Each direction-changeable connector has an opposite end coupled to a surface of the base station antenna. The linear actuator has an end coupled to the fixed member and an opposite end carrying an operation rod coupled to an end of the direction-changeable connectors that is not mounted to the fixed member and the base station antenna, whereby a direction-changeable structure of at least three points is formed between the base station antenna and the fixed member for changing direction in at least one orientation.

10 Claims, 7 Drawing Sheets

MULTI-POINT DRIVING DEVICE FOR GENERAL PURPOSE BASE STATION ANTENNA

BACKGROUND OF THE INVENTION

1. Field of the Invention

The present invention relates to a multi-point driving device for general-purpose base station antenna, and in particular to an electronic scale that features automatic cable retraction and is applicable to weighing of an object.

2. The Related Arts

Conventional directional base station antennas have been widely used in mobile communication systems. For example, an antenna of base station is used in a mobile phone communication system to effect transmission of signal and to realize an effective transmission of signal through a conventional directional antenna, variation of the azimuth angle and tilt angle of the antenna must be properly controlled. A conventional driving mechanism that is used to vary azimuth angle and tilt angle of a base station antenna is generally classified as two groups, of which one comprises installation of driving components, such as linkage or worm and motor, inside a base station antenna for driving the antenna to vary the azimuth or tilt angle. However, such an arrangement must install complicated driving components, such as linkage or worm and motor, in an interior space of the base station antenna and this complicates the structure of the base station antenna, making the manufacture and maintenance of the base station antenna difficult and also making the manufacture cost of the base station antenna excessively high. Further, the exterior of the base station antenna must be fixed by applying an additional fixture and this takes another expense of installation of the base station antenna.

Another know driving mechanism for varying azimuth angle of base station antenna takes the form of single-point single-direction rotary driving mechanism, as well as associated method, that is mounted at a bottom end or a central section of the exterior of the base station antenna. For example, when the base station antenna is rotated to vary azimuth angle, it is not possible to simultaneously vary the azimuth angle and the tilt angle of the base station antenna, whereby a driving mechanism must be additionally arranged inside the base station antenna to effect driving and varying of the antenna tilt angle. The same problem and drawback as the previously discussed arrangement of installing tilt angle driving mechanism in the interior of the base station antenna is applicable here again. Further, the base station antenna, which is usually disposed outdoors, must be resistive to interference caused by loading of wind power. In addition, the rotary driving mechanism is arranged at the bottom of the base station antenna, and it is necessary to bypass control cables and power cables connected to the bottom of the base station antenna. Further, such control cables and power cables may be uncontrollably cause twisting or entangling problem at the bottom of the base station antenna during the rotation of the base station antenna.

Known references include for example Taiwan Patent Publication No. 538557, which discloses an invention relating to honeycomb base station antenna, Taiwan Patent Publication No. 320786, which discloses a driving device that adjusts a plurality of phase shifters to induce relative phase shifting, an antenna system, and a communication system, Chinese Patent Publication No. CN102122758, which discloses a base station antenna capable of electrically adjusting electric downward inclination and a control method thereof, US Patent Publication No. 2009/0135074, which relates to a "single drive variable azimuth and beam tilt antenna for wireless network", US Patent Publication No. 2010/0201590, which relates to a "remote electrical tilt antenna with motor and clutch assembly", and U.S. Pat. No. 7,015,871, which relates to a "mobile radio antenna arrangement for a base station". All these prior art references disclose the typical known techniques that arrange tilt angle or azimuth angle driving mechanism in the interior of a base station antenna. And, similar to the previously discussed conventional base station antennas, these prior art references share the same problems and drawbacks of being difficult to manufacture and maintain, excessively high costs, and requiring additionally mounted fixtures outside the base station antenna that are caused by arranging the driving mechanism for controlling azimuth angle or tilt angle in the interior thereof.

Further, Taiwan Patent Publication No. 253917, which relates to an antenna direction adjusting device for mobile phone base station, and Taiwan Utility Model No. M398208, which relates to a universal horizontal rotation unit for directional antenna, both disclose effecting rotation of azimuth angle through single-point driving, and thus rotating, of the base station antenna that is performed at a bottom end or central section of the exterior of a base station antenna. Again, the same problems and drawbacks of single-point driving at the bottom end and central section of the exterior of the base station antenna being incapable of simultaneously varying the tilt angle, insufficient capability of resisting interference caused by loading of wind power, and being necessary to bypass the control cables and the power cables arranged at the bottom of the base station antenna in order to eliminate entangling of cables, which are found in the previously discussed antenna

SUMMARY OF THE INVENTION

The conventional driving mechanism for varying tilt angle or azimuth angle of the base station antenna is limited to rotation that is effected internally or rotation that is caused by single-point, single-direction driving on the exterior and these induce certain problems and drawbacks of being different to manufacture and maintain, excessively high cost, requiring an additionally installed fixture structure at the exterior of the base station antenna, insufficient capability of resisting interference caused by loading of wind power, and being necessary to bypass the control cables and power cables that are arranged at the bottom of the base station antenna.

Thus, it is desired to have a multi-point driving device that is of low cost, is easy to maintain, requires no additionally installed external fixture structure, is capable of precise adjustment of tilt angle and azimuth angle and structure positioning, comprises self-locking feature to resist loading induced by wind power, and is totally free of the issue of bypassing and entangling of control cables and power cables at the bottom of the base station antenna.

The present invention provides a multi-point driving device for general-purpose base station antenna, which comprises a fixed member, at least three direction-changeable connectors, a rigid base station antenna, and at least one linear actuator. The fixed member is coupled to an end of at least one of the direction-changeable connectors, which provides a function of direction change. Each of the direction-changeable connectors has an opposite end coupled to a surface of the base station antenna. The linear actuator has an end coupled to the fixed member and an opposite end carrying an operation rod coupled to an end of the direction-changeable connectors that is not mounted to the fixed member and the base station antenna, whereby a direction-changeable structure of at least three points is formed between the base station antenna and the fixed member for changing direction in at least one orientation. The linear actuator is operable to provide a linear driving force through selective extension and contraction of the operation rod for realizing multi-point driving to vary azimuth angle or tilt angle or both of the base station antenna.

The present invention provides a multi-point driving device for base station antenna of which the efficacy is that at least three direction-changeable connectors that are connected between a fixed member and a base station antenna form a single-direction or multiple-direction direction-change mechanism of three point coupling. A linear actuator is provided to apply a linear driving force to the direction-changeable connector of one of the three points to realize multi-point driving to vary one of azimuth angle and tilt angle of the base station antenna or both azimuth angle and tilt angle, whereby a driving mechanism is formed when the base station antenna varies azimuth angle or tilt angle and a self-locking structure is formed by the linear actuator, the direction-changeable connectors, and the fixed member when not in operation so as to realize precise positioning and fixing, be capable of bear interference caused by loading of wind power, greatly reduce manufacture, maintenance, and installation costs of the base station antenna, and require no external fixture and associated installation expense. Further, positioning through the at least three direction-changeable connectors makes it possible not bypass or concern about entangling of control cables and power cables arranged at the bottom of the base station antenna when the base station antenna is driven to vary azimuth angle and/or tilt angle.

BRIEF DESCRIPTION OF THE DRAWINGS

The present invention will be apparent to those skilled in the art by reading the following description of preferred embodiments thereof, with reference to the attached drawings, wherein.

DETAILED DESCRIPTION OF THE PREFERRED EMBODIMENTS

Figure 1:
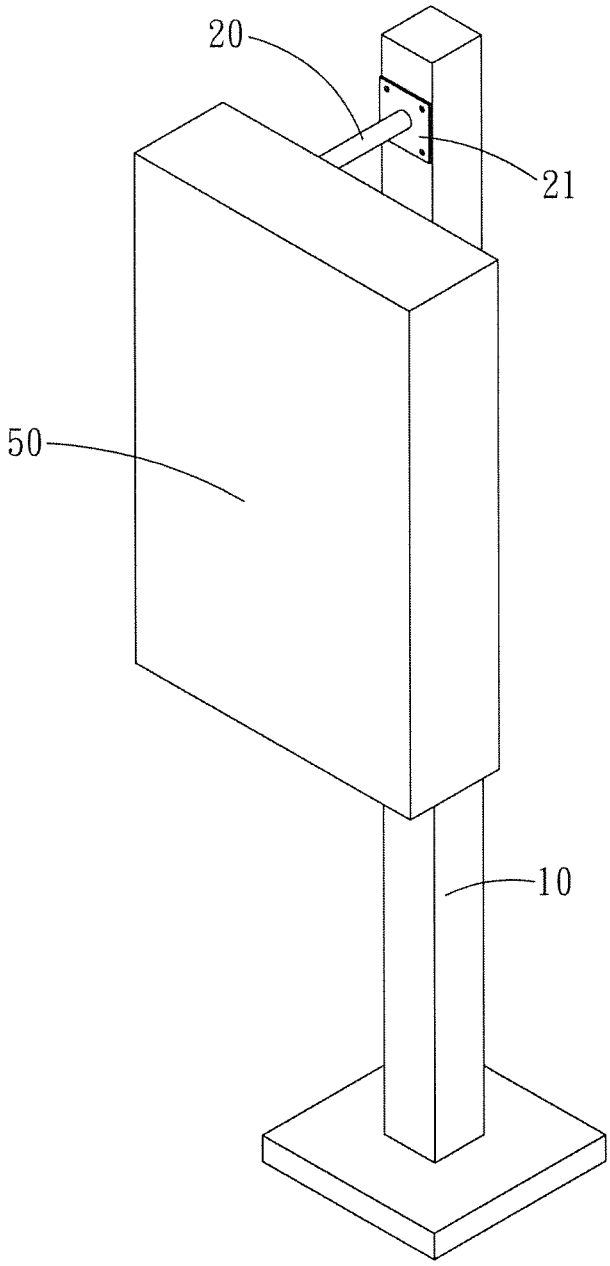
FIG. 1 is a perspective view showing a multi-point driving device for general-purpose base station antenna constructed in accordance with a first embodiment of the present invention.
Figure 2:
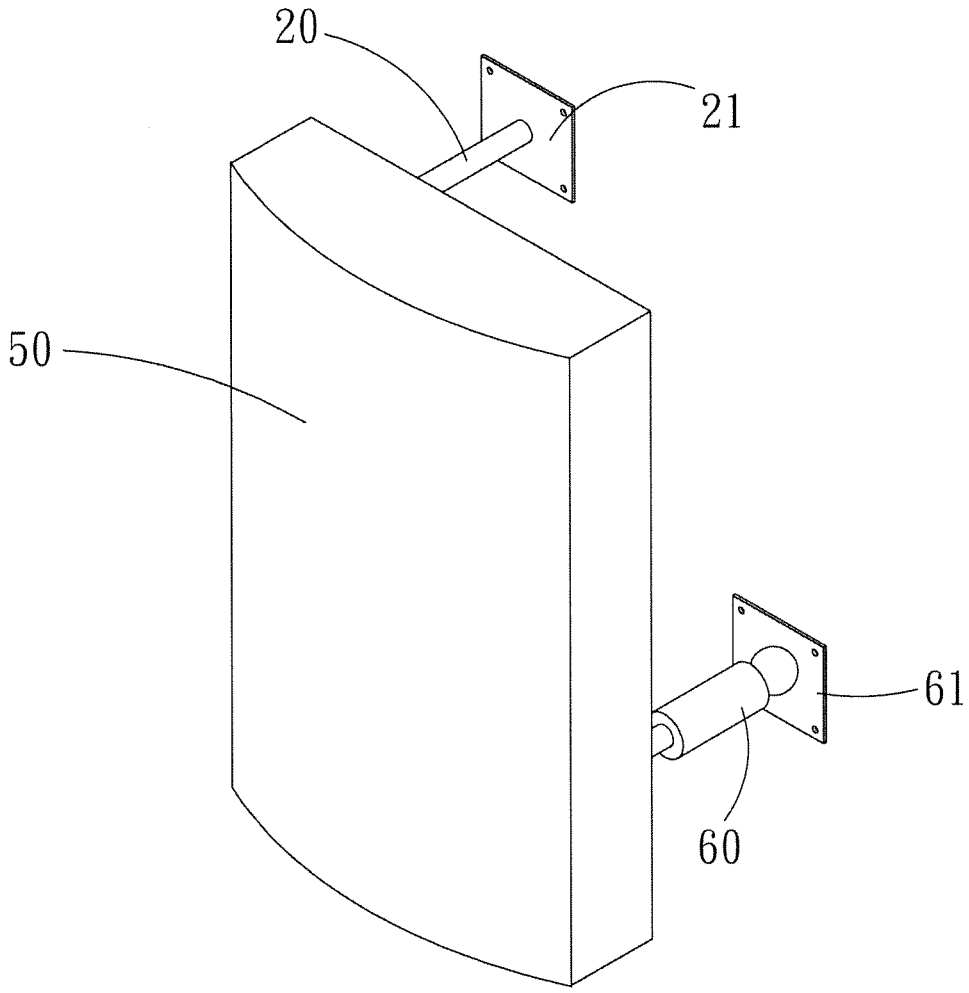
FIG. 2 is a front-side perspective view showing a linear actuator coupled to the base station antenna.
Figure 3:
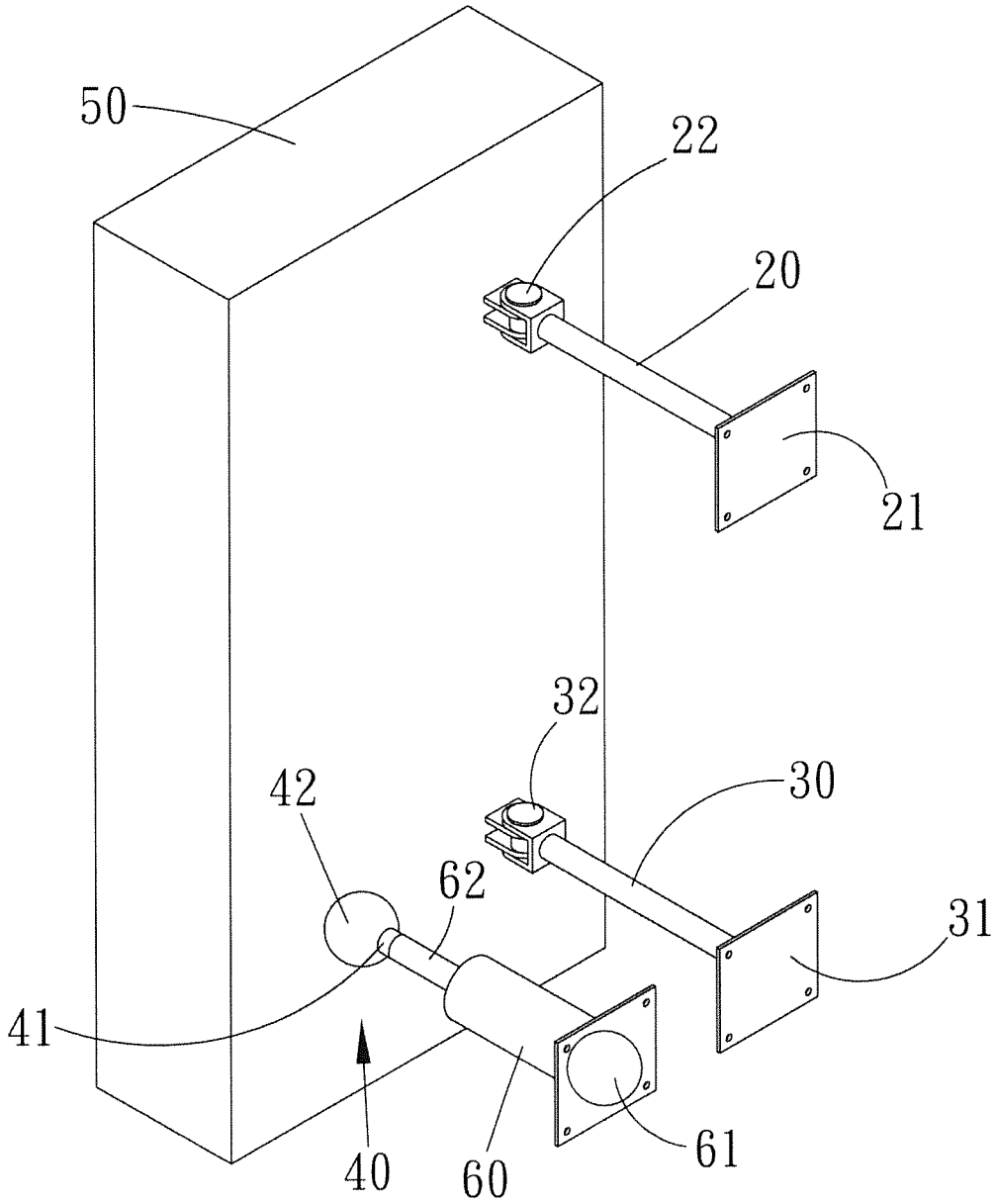
FIG. 3 is a rear-side perspective view showing positions where direction-changeable connectors are coupled to the base station antenna.

With reference to the drawings and in particular to FIGS. 1, 2, and 3, a multi-point driving device, generally designated at 100, constructed in accordance with a first embodiment of the present invention is provided for a general-purpose base station antenna. The multi-point driving device 100 comprises a fixed member 10, which is not limited to any specific form and can be for example a wall, a cylindrical post, a square post, and a mounting board, and a square post is taken as an example in the first embodiment of the present invention.

At least three direction-changeable connectors 20, 30, and 40 are included. The direction-changeable connectors 20, 30, and 40 have a function of changing direction in at least one direction. In the first embodiment of the present invention, a single pivotal joint that is capable of changing direction on a horizontal plane is taken as an example for the direction-changeable connectors 20 and 3, while an example of the direction-changeable connector 40 is a universal joint. It is apparent that all three direction-changeable connectors 20, 30, and 40 can be universal joints or ball joints. Each of the direction-changeable connectors 20, 30, and 40 has two ends respectively forming a mounting end 21, 31, 41 and a rotatable end 22, 32, 42. The mounting end 21, 31 of the direction-changeable connectors 20, 30 are respectively mounted to upper and lower end portions of the fixed member 10, whereby the mounting end 21 of the direction-changeable connector 20 and the mounting end 31 of the direction-changeable connector 30 are set on the same vertical line.

A base station antenna 50, which can be of any general-purpose base station antenna, has an upper end to which the rotatable end 22 of the direction-changeable connector 20 is coupled. The rotatable end 32 of the direction-changeable connector 30 is coupled to a lower end of the base station antenna 50. The rotatable end 42 of the direction-changeable connector 40 is coupled to the lower end of the base station antenna 50 and is located at one side of the rotatable end 32 of the direction-changeable connector 30. The rotatable end 22 of the direction-changeable connector 20 and the rotatable end 32 of the direction-changeable connector 30 are located on the same vertical line and the rotatable end 42 of the direction-changeable connector 40 and the rotatable end 32 of the direction-changeable connector 30 are located on the same horizontal line, whereby the surface of the base station antenna 50 that opposes the direction-changeable connectors 20, 30, and 40 forms a structure that is fixed and coupled by at least three points.

At least one linear actuator 60 is included, which is not limited to any specific form. A linear driving bar device that is driven by a motor is taken as an example in this embodiment, yet other linear driving mechanisms having an equivalent function, such as pneumatic cylinder, hydraulic cylinder, or electromagnetic solenoid, or even manually-operated extendible/retractable push bar, are considered within the scope of the present invention. The linear actuator 60 has an end forming a movable coupling end 61, which is fixed to a lower end portion of the fixed member 10. The movable coupling end 61 is not limited to any specific form and a universal joint is taken as an example in the present invention. The linear actuator 60 has an opposite end that carries an operation rod 62, which is capable of linear extension/contraction. An end of the operation rod 62 is coupled to the mounting end 41 of the direction-changeable connector 40, whereby the rotatable end 42 of the direction-changeable connector 40 is driven to deflect by the extending/contracting linear movement of the operation rod 62 of the linear actuator 60 so as to cause the base station antenna 50 to vary or adjust the azimuth angle thereof.

Figure 4:
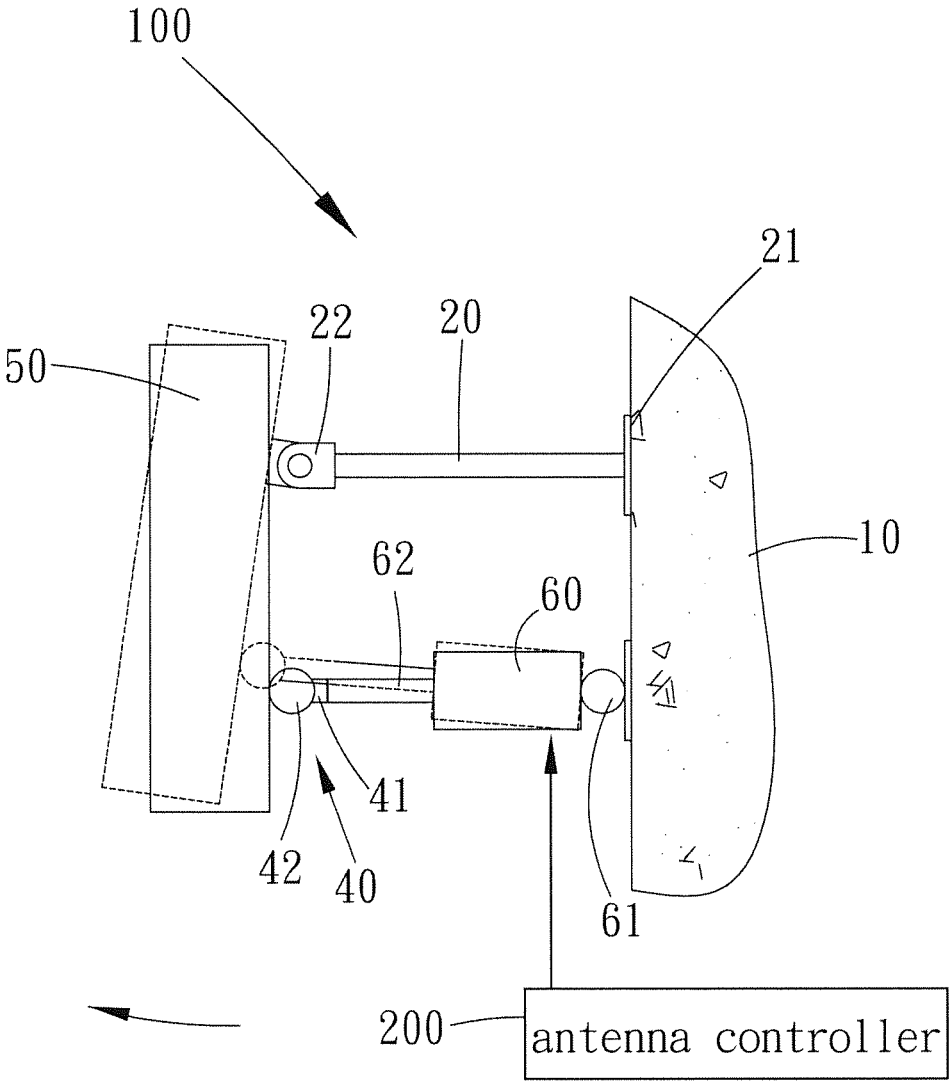
FIG. 4 is a top plan view showing an example of application of the multi-point driving device for general-purpose base station antenna.

Referring to FIG. 4, an example of application of the multi-point driving device 100 according to the present invention is illustrated, wherein the linear actuator 60 is connected to an antenna controller 200, whereby the linear actuator 60 is controlled by the antenna controller 200 to drive extending/contracting linear movement of the operation rod 62 so that, through the direction-changeable connections provided by the three direction-changeable connectors 20, 30, and 40, the base station antenna 50 may take a rotating movement about a rotational axis defined by the rotatable end 22 of the direction-changeable connector 20 and the rotatable end 32 of the direction-changeable connector 30 to vary and adjust the azimuth angle thereof. At the same time, the linear actuator 60 may, based on the movable coupling end 61 thereof, rotate in unison with the base station antenna 50 (as indicated by the arrow shown in FIG. 4). In the operation of the linear actuator 60, the three direction-changeable connectors 20, 30, and 40 and the base station antenna 50, which is rigid, form a moving mechanism for varying the azimuth angle, while when the linear actuator 60 stops operation, the linear actuator 60 and the three direction-changeable connectors 20, 30, and 40 collectively form a self-locked fixed structure with respect to the fixed member 10 and the base station antenna 50 respectively, whereby there is no need to provide an additional structure for fixing the base station antenna 50 and the base station antenna 50 may be rotated to a desired location precisely and then fixed.

The mounting end 21 and the rotatable end 22 of the direction-changeable connector 20 and the mounting end 31 and the rotatable end 32 of the direction-changeable connector 30, which are shown in FIGS. 1-4 discussed above, are not limited to in such an arrangement that the mounting ends 21, 31 are fixed to the fixed member 10 and the rotatable ends 22, 32 coupled to a surface of the base station antenna 50, and such an arrangement can be done in a reversed manner, namely the mounting end 21 of the direction-changeable connector 20 and the mounting end 31 of the direction-changeable connector 30 are respectively mounted to the upper and lower ends of the base station antenna 50, while the rotatable ends 22, 32 are respectively coupled to the upper and lower end portions of the fixed member 10. This is equally effective to provide the variation of azimuth angle and the function of operation and self-locking by at least three points for the base station antenna 50, as discussed above.

Figure 5:
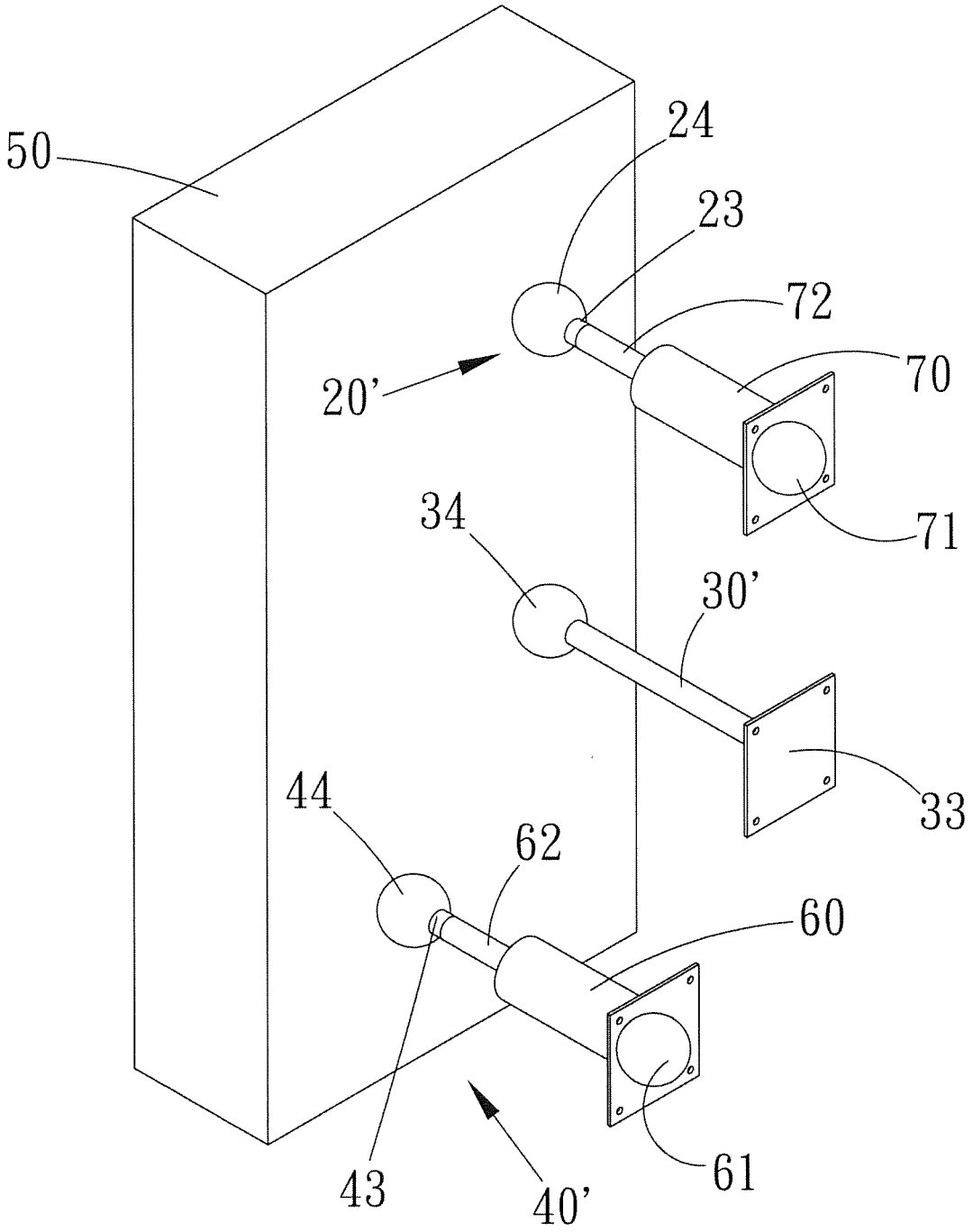
FIG. 5 is a perspective view showing a multi-point driving device for general-purpose base station antenna constructed in accordance with a second embodiment of the present invention.
Figure 6:
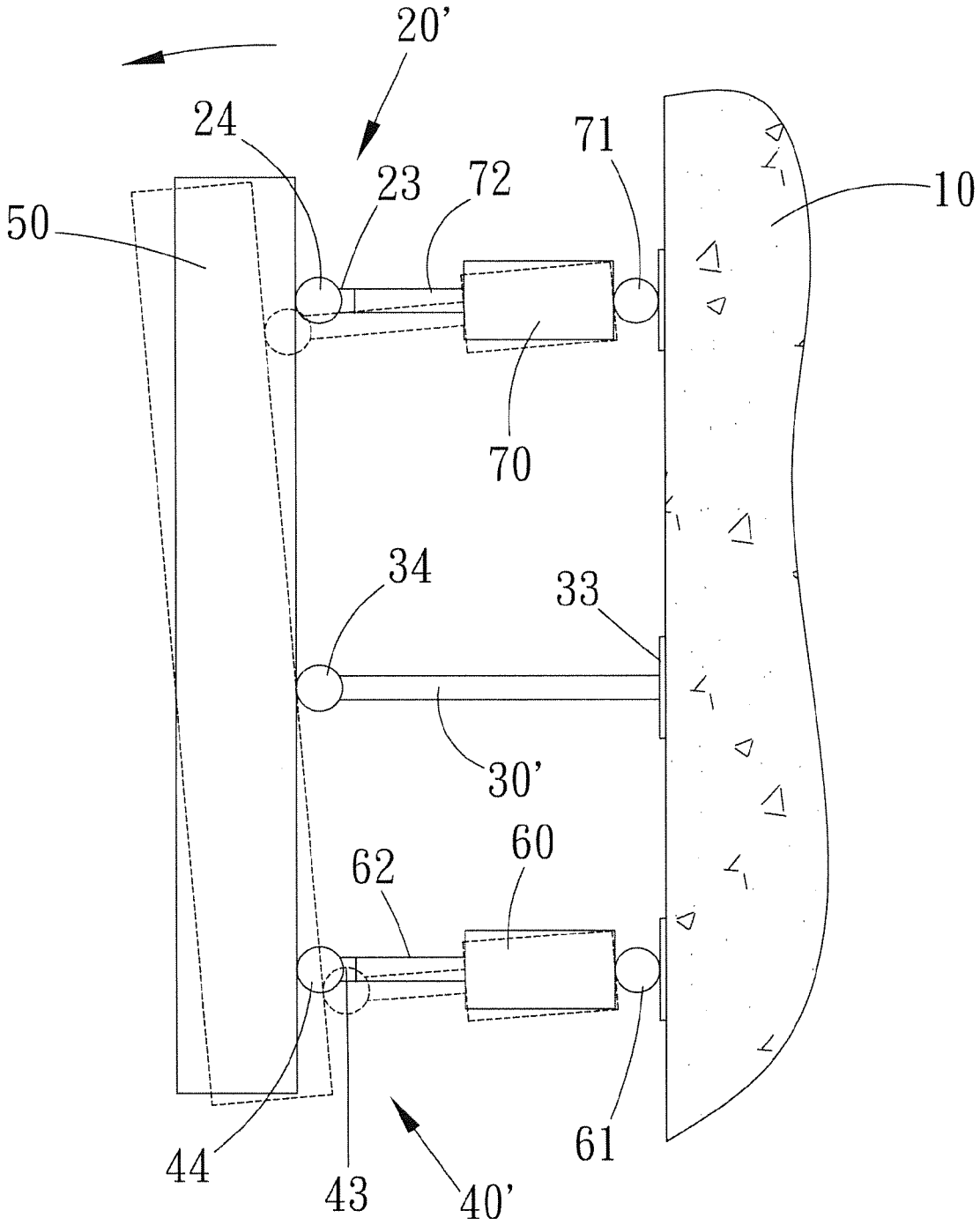
FIG. 6 is a side elevational view showing variation of tilt angle of the base station antenna shown in FIG. 5.
Figure 7:
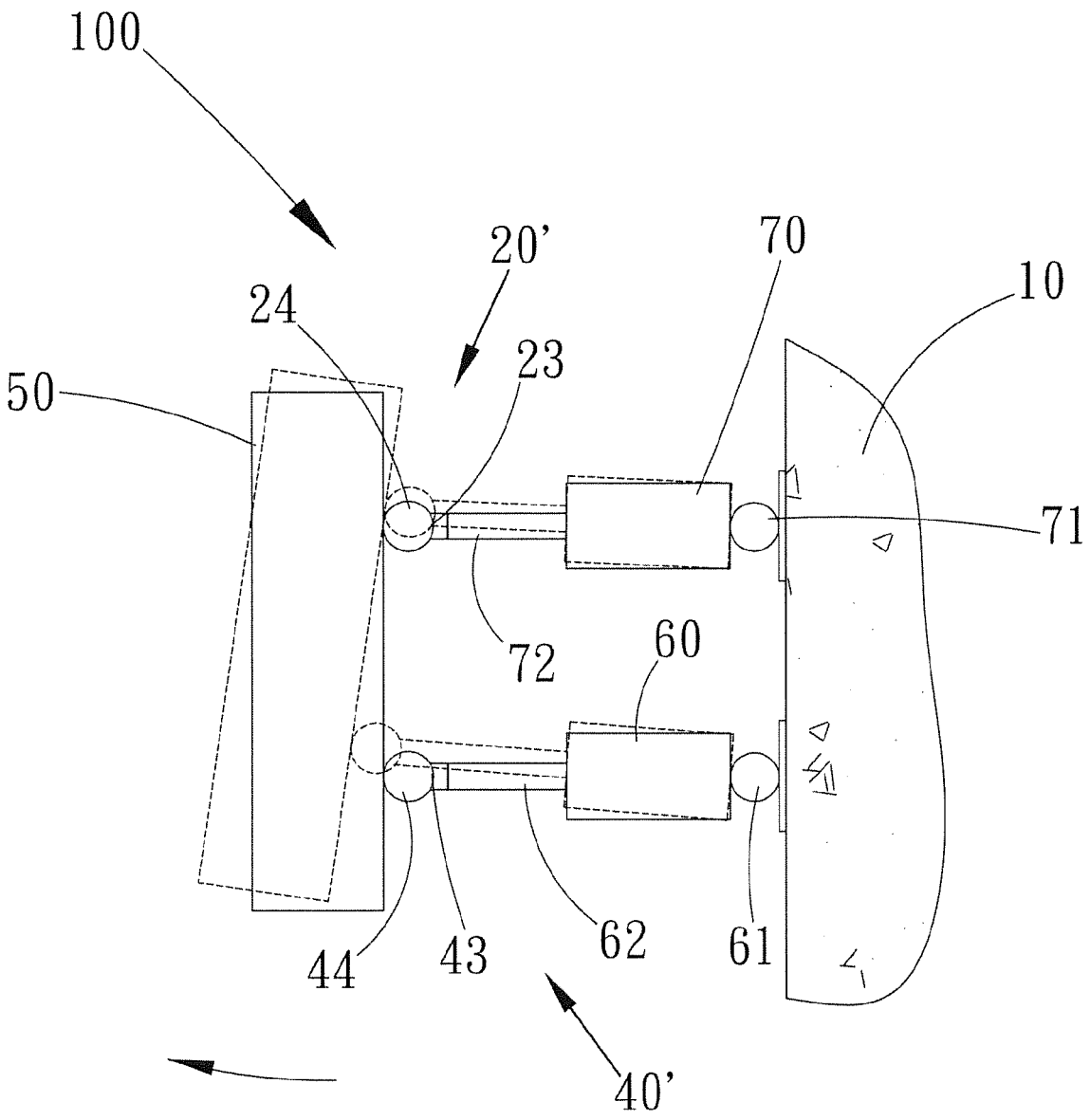
FIG. 7 is a top plan view showing variation of azimuth angle of the base station antenna shown in FIG. 5.

Referring to FIGS. 5, 6, and 7, a multi-point driving device, also designated at 100, constructed in accordance with a second embodiment of the present invention is provided, wherein all three direction-changeable connectors 20', 30', and 40' are universal joints that are capable of rotations in horizontal direction and vertical direction. Each of the direction-changeable connectors 20', 30', and 40' has two ends respectively forming a mounting end 23, 33, 43 and a rotatable end 24, 34, 44. The rotatable end 24 of the direction-changeable connector 20' is coupled to the upper end of the base station antenna 50, the rotatable end 34 of the direction-changeable connector 30' is coupled to an intermediate section of the base station antenna 5 and the mounting end 33 mounted to an intermediate section of the fixed member 10, the rotatable end 44 of the direction-changeable connector 40' is coupled to the lower end of the base station antenna 50 but is sideways shifted and thus located at another side, whereby the rotatable end 24 of the direction-changeable connector 20' and the rotatable end 34 of the direction-changeable connector 30' are located on the same vertical line, while the rotatable end 44 of the direction-changeable connector 40' is not located on the vertical line defined by the rotatable end 24 of the direction-changeable connector 20' and the rotatable end 34 of the direction-changeable connector 30' and is also not located on any horizontal line passing through any one of the rotatable end 24 of the direction-changeable connector 20' and the rotatable end 34 of the direction-changeable connector 30'.

Two linear actuators 60, 70 are included, each having an end forming a movable coupling end 61, 71 respectively coupled to one side portion of a lower end of the fixed member 10 and an upper end of the fixed member 10. The linear actuator 60 has an end carrying an operation rod 62 of which an end is coupled to the mounting end 43 of the direction-changeable connector 40' and the linear actuator 70 has an end carrying an operation rod 72 that is coupled to the mounting end 23 of the direction-changeable connector 20', whereby through linear extension/contraction movement of the operation rod 62 of the linear actuator 60, the base station antenna 50 may take a rotating movement about a rotational axis defined by the rotatable end 24 of the direction-changeable connector 20' and the rotatable end 34 of the direction-changeable connector 30' to vary and adjust the azimuth angle thereof (as indicated by the arrow shown in FIG. 7).

Similarly, through linear extension/contraction movement of the operation rod 72 of the linear actuator 70 and also a relative contraction of extension of the operation rod 62 of the linear actuator 60, the base station antenna 50 make effect a driving operation by rotating about a rotational center defined by the rotatable end 34 of the direction-changeable connector 30' to vary and adjust tilt angle (as indicated by the arrow of FIG. 6). When the operation rod 62 of the linear actuator 60 and the operation rod 72 of the linear actuator 70 take linear extension or contraction movement, the fixed member 10, the three direction-changeable connectors 20', 30', 40', and the two linear actuators 60, 70 constitute a moving mechanism that varies and adjusts the azimuth angle and the tilt angle of the base station antenna 50, and when the operation rod 62 of the linear actuator 60 and the operation rod 72 of the linear actuator 70 stop operations, a self-locking mechanism is formed among the fixed member 10, the three direction-changeable connectors 20', 30', 40', and the two linear actuators 60, 70 that forms a structure for fixing the base station antenna 50 at precise position.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A multi-point driving device for general-purpose base station antenna, comprising:

a fixed member;

a base station antenna;

at least three direction-changeable connectors, of which at least one of the direction-changeable connectors has an end mounted to the fixed member, said one of the direction-changeable connectors providing a function of direction change, each of the direction-changeable connectors having an opposite end coupled to a surface of the base station antenna; and at least one linear actuator, which has an end coupled to the fixed member and an opposite end carrying an operation rod coupled to an end of the direction-changeable connectors that is not mounted to the fixed member and the base station antenna, whereby a direction-changeable structure of at least three points is formed between the base station antenna and the fixed member for changing direction in at least one orientation, the linear actuator being operable to provide a linear driving force through selective extension and contraction of the operation rod for realizing multi-point driving to vary azimuth angle or tilt angle or both of the base station antenna.

2. The multi-point driving device for general-purpose base station antenna as claimed in claim 1, wherein the direction-changeable connector comprises a universal joint.

3. The multi-point driving device for general-purpose base station antenna as claimed in claim 1, wherein the direction-changeable connector comprises a ball joint.

4. The multi-point driving device for general-purpose base station antenna as claimed in claim 1, wherein the direction-changeable connector comprises a pivotal joint.

5. The multi-point driving device for general-purpose base station antenna as claimed in claim 1, wherein each of the direction-changeable connectors has two ends respectively forming a mounting end and a rotatable end, the rotatable ends being coupled to the surface of the base station antenna, the mounting ends being respectively mounted to the fixed member and the operation rod of the linear actuator.

6. The multi-point driving device for general-purpose base station antenna as claimed in claim 1, wherein each of the direction-changeable connectors has two ends respectively forming a mounting end and a rotatable end, the rotatable end of at least one of the direction-changeable connectors being coupled to the surface of the base station antenna and the mounting end being coupled to the operation rod of the linear actuator, the mounting end of each of the remaining two direction-changeable connectors being coupled to the surface of the base station antenna and the rotatable end being rotatable in a horizontal surface and mounted to the fixed member.

7. The multi-point driving device for general-purpose base station antenna as claimed in claim 1, wherein the linear actuator comprises a linear driving bar device driven by a motor.

8. The multi-point driving device for general-purpose base station antenna as claimed in claim 1, wherein the linear actuator has an end forming a movable coupling end coupled to the fixed member.

9. The multi-point driving device for general-purpose base station antenna as claimed in claim 8, wherein the movable coupling end comprises a universal joint.

10. The multi-point driving device for general-purpose base station antenna as claimed in claim 1, wherein the linear actuator is connected to an antenna controller in order to be controlled by the antenna controller.

* * * * *